US006954216B1

(12) United States Patent
Dowling et al.

(10) Patent No.: US 6,954,216 B1
(45) Date of Patent: Oct. 11, 2005

(54) DEVICE-SPECIFIC COLOR INTENSITY SETTINGS AND SUB-PIXEL GEOMETRY

(75) Inventors: Terence S. Dowling, San Jose, CA (US); Jeremy A. Hall, San Jose, CA (US)

(73) Assignee: Adobe Systems Incorporated, San Jose, CA (US)

( * ) Notice: Subject to any disclaimer, the term of this patent is extended or adjusted under 35 U.S.C. 154(b) by 0 days.

(21) Appl. No.: 09/378,227

(22) Filed: Aug. 19, 1999

(51) Int. Cl.[7] ..... G09G 5/02
(52) U.S. Cl. ..... 345/593; 345/613
(58) Field of Search ..... 345/77, 88, 89, 345/204, 594, 598, 604, 613, 690, 694–699, 345/600, 614, 618, 593, 3.1, 3.3, 3.4, 589, 345/591, 601; 358/51.8

(56) References Cited

U.S. PATENT DOCUMENTS 4,892,391 A * 1/1990 Stewart et al. ..... 349/143
5,483,259 A * 1/1996 Sachs ..... 345/594
5,563,725 A * 10/1996 Kumada et al. ..... 358/518
5,614,925 A * 3/1997 Braudaway et al. ..... 345/593
5,638,117 A * 6/1997 Engeldrum et al. ..... 348/179
5,751,272 A * 5/1998 Silverbrook et al. ..... 345/694
6,014,258 A * 1/2000 Naka et al. ..... 345/589
6,088,038 A * 7/2000 Edge et al. ..... 345/600
6,091,518 A * 7/2000 Anabuki ..... 358/518
6,278,434 B1 * 8/2001 Hill et al. ..... 345/468
6,326,981 B1 * 12/2001 Mori et al. ..... 345/694
6,563,502 B1 * 5/2003 Dowling et al. ..... 345/469.1

OTHER PUBLICATIONS

Simpson Mastering Wordperfect 5.1 &5.2 for Windows (Copyright 1993) pp. 170-173 and 463-465.*

* cited by examiner

*Primary Examiner*—Chanh Nguyen
(74) *Attorney, Agent, or Firm*—Fish & Richardson P.C.

(57) ABSTRACT

A method for determining device-specific information for pixels to obtain an optimal display of fine structure monochrome images on an output display device, the method comprising determining a set of device-specific pixel input values that will cause the display system to display a corresponding set of target visual output intensities relative to the output display device, and determining a device-specific sub-pixel geometry for all the pixels of the output display device. Displaying for each of the pixels a selected visual output intensity relative to the output display device at a sub-pixel position according to a corresponding pixel input value will cause an optimal display of fine structure monochrome images to be displayed on the output display device.

71 Claims, 4 Drawing Sheets

Patterns formed in reference regions, each reference region having an average visual output intensity at 50%

Different pixel arrangements
| | |
|---|---|
| R-G-B | B-G-R |
| B-R-G | G-R-B |
| R-B-G | G-B-R |
FIG. 6
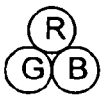
FIG. 10a
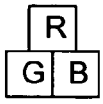
FIG. 10b
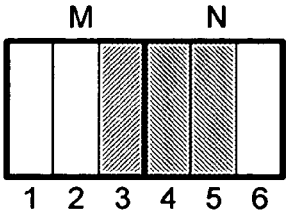
FIG. 7a
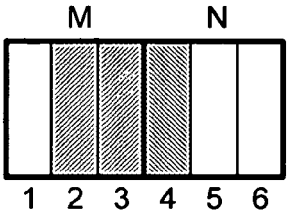
FIG. 7b
R-G-B test implemented on R-G-B output display device
FIG. 8a
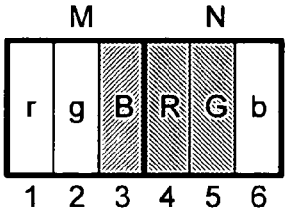
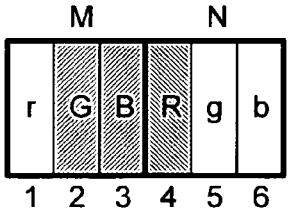
B-G-R test implemented on B-G-R output display device
FIG. 8b
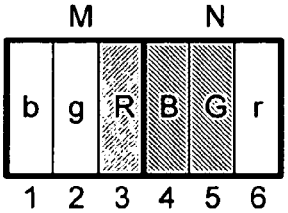
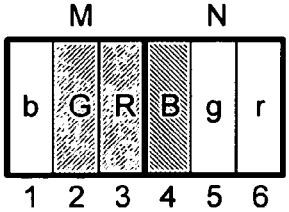
B-G-R test implemented on R-G-B output display device
FIG. 9
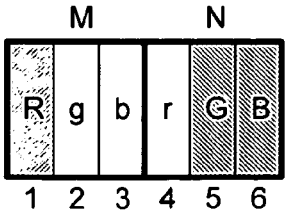
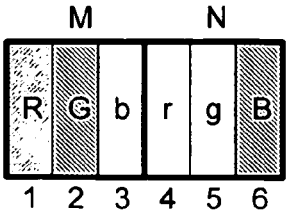

DEVICE-SPECIFIC COLOR INTENSITY SETTINGS AND SUB-PIXEL GEOMETRY

BACKGROUND OF THE INVENTION

The present invention relates to device-specific information for pixels.

Color in computer graphics is defined in terms of "color spaces", which are related to real or imaginary color display devices such as monitors, liquid crystal displays and color printers. Various color spaces are used to represent color on computers. Each image is associated with a color space which defines colors according to a combination of properties. For example, in a RGB (Red, Green, Blue) color space, each color is represented by a combination of red, green and blue components. In a CMYK (Cyan, Magenta, Yellow, Black) color space, each color is represented as a combination of cyan, magenta, yellow and black.

An output display device such as a computer monitor, liquid crystal display (LCD) or printer is capable of reproducing a limited range of colors. An output display device's "color gamut" is the set of colors that the output display device is capable of reproducing. Similarly, the "visible color gamut" is the set of colors that the human eye is capable of perceiving. Color gamuts can be represented as a two-dimensional projection of their three-dimensional representations onto the plane of constant luminance.

Typically, color display devices are constructed from an array of pixels that are themselves composed of several (typically three) differently colored components or sub-pixels. The input values of these sub-pixels may be varied from full off to full on to cause the output display device to display the pixels at visual output intensities corresponding to the pixel input values. The perceived color of each pixel is the aggregate of the visual output intensities and colors of its sub-pixels. Thus, a pixel can take a range of values through the color spectrum by varying the input values of its sub-pixels.

A pixel's color is generally represented by a series of bits (the "color value"), with specific bits indicating a visual output intensity for each sub-pixel used in the color. The specific sub-pixels depend on the color system used. Thus, a 24-bit RGB data representation may allocate bits 0–7 to indicate the amount of blue, bits 8–15 to indicate the amount of green, and bits 16–23 to indicate the amount of red, as shown in FIG. 3. Such a representation can produce any one of nearly 17 million different pixel colors (i.e., the number of unique combinations of 256 input values of red, green, and blue). By contrast, systems that allocate fewer bits of memory to storing color data can produce only images having a limited number of colors. For example, an 8-bit color image can include only 256 different colors.

On a color display device such as an LCD screen with a horizontal resolution of 800 pixels, the LCD screen can actually be composed of 800 red, 800 green, and 800 blue sub-pixels interleaved together (R-G-B-R-G-B-R-G-B . . . ) to form a linear array of 2400 single-color sub-pixels. Each sub-pixel is independently addressable, that is a color value can be set for each individual sub-pixel of the color display device. While each of the sub-pixels is individually addressable, the human eye sees (visible color gamut) a blending of the sub-pixels. For example, a single pixel wide white line can be produced by setting the input values of all sub-pixels for a row or column of pixels to a maximum value. The human eye does not 'see' closely spaced colors individually, and as such, cannot distinguish the individual color components. Instead, our vision system deliberately mixes the colors in combination to form intermediates, in this case the color white.

To display a fine structure monochrome image with fine detail such as black text on a white background or white text on a black background on a color display device or a monochrome display device, special attention must be paid to the visual output intensity of each sub-pixel in order to reduce color fringing effects. Unfortunately, device-specific pixel information that look good when used in displaying the text on one type of output display device may show color fringing effects when used in conjunction with other types of output display devices.

Color display devices may be constructed using different geometries of colored sub-pixels associated with each pixel. Depending on the color display device, different sub-pixel geometries result in various degrees of color fringing of monochrome images. Not all LCD screens, for example, have the same linear ordering of sub-pixels, for example a R-G-B ordering for a RGB color space type of output device. Other possible orderings include R-B-G, B-G-R, B-R-G, G-B-R and G-R-B. When two sets of images, one produced on an LCD device having a R-G-B sub-pixel geometry and the other produced on an LCD device having a B-G-R sub-pixel geometry such that neither LCD device displays color fringing, are displayed on a third LCD device having a R-G-B sub-pixel geometry, only the set of images with R-G-B ordering will appear without color-fringing. The set of images with B-G-R ordering will appear color-fringed. It would therefore be an advantage if the sub-pixel geometry for all pixel of an output device could be determined prior to display of an image so as to minimize the effect of color fringing.

For a given color display device, to minimize color fringing of finely detailed monochrome images, the proper intensity settings for each of the sub-pixels that make up a pixel as well as the sub-pixel geometry must be found.

SUMMARY OF THE INVENTION

The invention provides a method for determining device-specific information for pixels to obtain an optimal display of fine structure monochrome images on an output display device.

In one aspect, the invention provides a method for determining a set of device-specific pixel input values that will cause the display system to display a corresponding set of target output intensities relative to the output display device. The method includes obtaining a target visual output intensity, establishing a reference region in a display device, selecting a pixel input value for each of the reference pixels, displaying the reference region with the selected pixel input values for the reference pixels, displaying a control region on the display device, adjusting the common pixel input value in response to user input, and associating the common pixel input value with the target visual output intensity when a user input indicates a match between the appearance of the reference region and the appearance of the control region. The invention further provides a method for determining a device-specific sub-pixel geometry for all the pixels of the output display device. Each pixel includes sub-pixels each defining a color component and a sub-pixel position associated with a given pixel. The method includes displaying a plurality of regions, one for each possible sub-pixel geometry, each region including a pattern that is susceptible to color fringing depending on the sub-pixel geometry for the output display device, and prompting a user to select a region. Displaying for each of the pixels a selected visual output intensity relative to the output display device at a sub-pixel position according to a corresponding pixel input value will cause an optimal display of fine structure images to be displayed on the output display device.

In another aspect, the invention provides a method for determining a set of device-specific pixel input values that will cause the display system to display a corresponding set of target output intensities relative to a liquid crystal display (LCD) device. The invention further includes providing a method for determining a device-specific sub-pixel geometry for all the pixels of the liquid crystal display (LCD) device. Displaying for each of the pixels a selected visual output intensity relative to the liquid crystal display (LCD) device at a sub-pixel position according to a corresponding pixel input value will cause an optimal display of fine structure images to be displayed on the liquid crystal display (LCD) device.

Advantages that can be seen in implementations of the invention include one or more of the following. A user can determine a set of device-specific pixel input values that will cause a display system to display a corresponding set of target visual output intensities relative to the output display device such that fine structure monochrome images displayed appear to the user to be optimal for the output display device. A user can select a device-specific sub-pixel geometry for all pixels of the output display device where each pixel includes a plurality of sub-pixels each defining a color component and a sub-pixel position associated with a given pixel such that color fringing is minimized.

Another advantage is the method is intuitive for the user and can be accomplished quickly and accurately with little required knowledge of the underlying technology or device. Among the situations where this might be used would be presentation situations where the method is used to calibrate a display system in a conference room or large gathering display system.

The details of one or more embodiments of the invention are set forth in the accompanying drawings and the description below. Other features and advantages of the invention will become apparent from the description, the drawings, and the claims.

BRIEF DESCRIPTION OF THE DRAWINGS

FIG. 6 shows every possible ordering of sub-pixels in a RGB output display device.

FIG. 7*a* shows two adjacent pixels including sub-pixels numbered 1–6 from left to right where sub-pixels 3–5 are illuminated.

FIG. 7*b* shows two adjacent pixels including sub-pixels numbering 1–6 from left to right where sub-pixels 2–4 are illuminated.

FIG. 8*a* is a R-G-B sub-pixel geometry test implemented on two adjacent pixels in a R-G-B output display device.

FIG. 8*b* is a B-G-R sub-pixel geometry test implemented on two adjacent pixels in a B-G-R output display device.

FIG. 9 shows the result of implementing a B-G-R sub-pixel geometry test on two adjacent pixels in a R-G-B output display device.

FIGS. 10*a* and 10*b* show alternate sub-pixel geometries for pixels in RGB color space.

Like reference numbers and designations in the various drawings indicate like elements.

DETAILED DESCRIPTION

Figure 1:
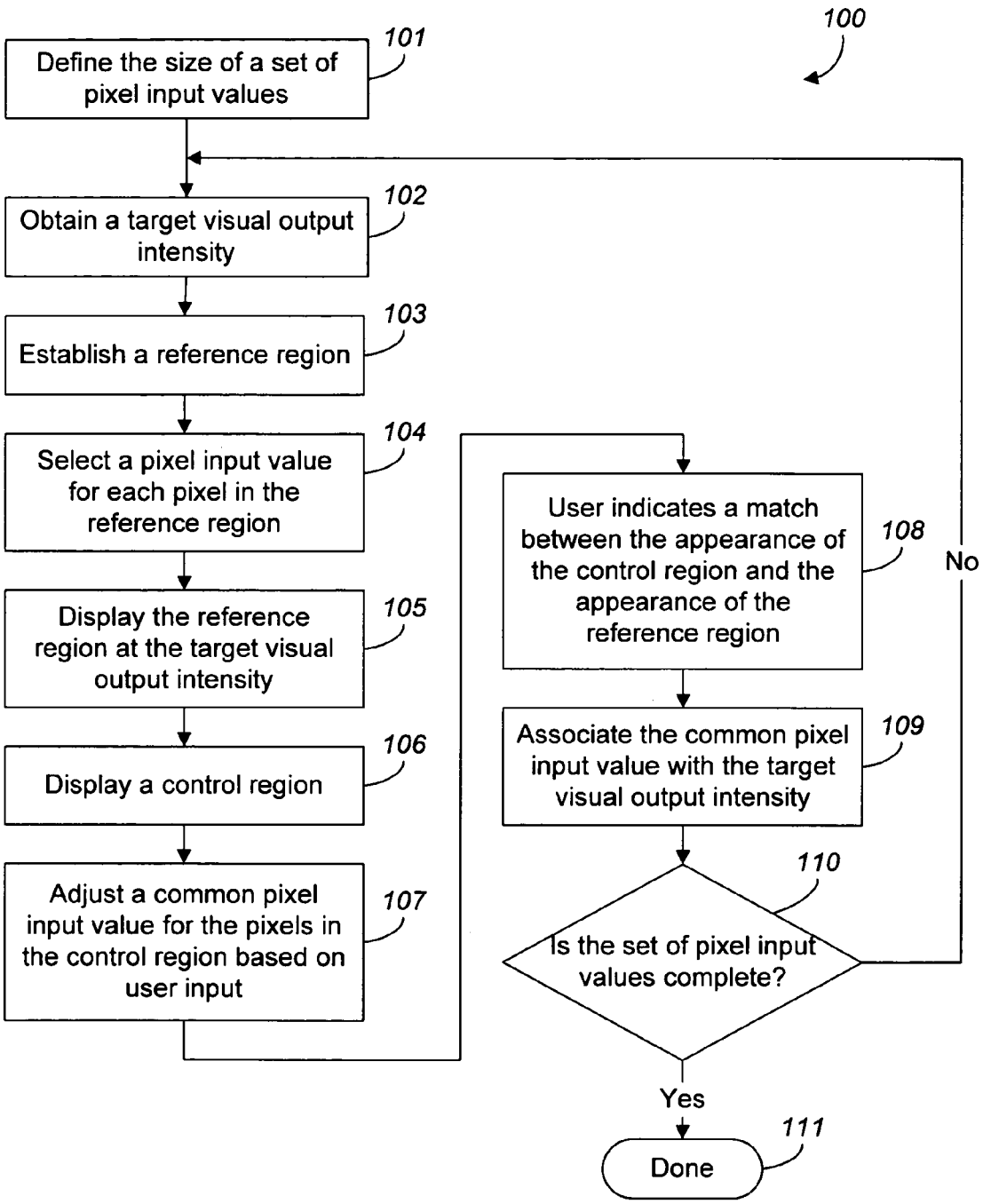
FIG. 1 is a flow diagram of a process for determining a set of device-specific pixel input values that will cause a display system to display a corresponding set of target visual output intensities relative to an output display device.

FIG. 1 is a flow diagram of a process 100 for determining a set of device-specific pixel input values that will cause a display system to display a corresponding set of target visual output intensities relative to an output display device.

The process 100 first obtains a numeric value defining the size of the set of pixel input values for which the corresponding visual output intensities are known (step 101) for the output display device 400. In one implementation, the user is prompted for the numeric value. In another implementation, the process 100 obtains a pre-programmed numeric value. The process 100 then obtains a target visual output intensity (step 102). In one implementation, the user is prompted for the target visual output intensity.

Figure 4:
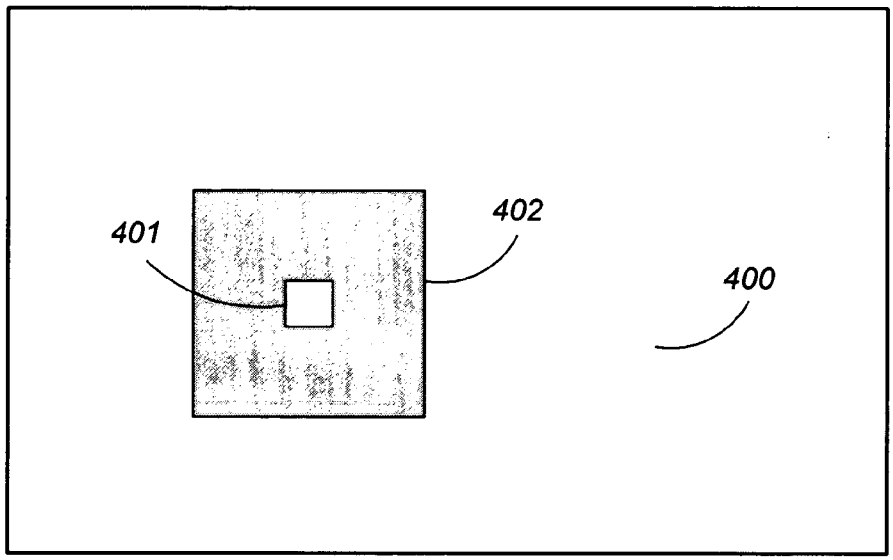
FIG. 4 illustrates a user interface presented on an output display device including a control region and a reference region.
Figure 5A:
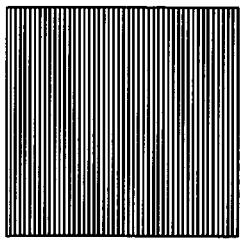
FIGS. 5*a* and 5*b* show reference regions having an average visual output intensity at 50%, where a pattern is formed in each reference region.
Figure 5B:
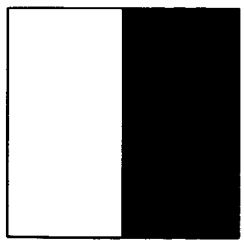

The process 100 then establishes a reference region 402 (step 103) defined by a plurality of reference pixels in the output display device 400, as shown in FIG. 4. The process 100 selects a pixel input value for each of the reference pixels from among a set of pixel input values for which the corresponding visual output intensities relative to the output display device 400 are known (step 104) such that the average of the visual output intensities of the reference pixels is the target visual output intensity. The pixel input values are selected such that no perceived patterns such as lines (FIG. 5*a*) or blocks (FIG. 5*b*) are formed in the reference region 402 which can distract the user. Problems associated with patterns are less likely to occur when combinations of pixel input values that are closer together are mixed. Patterns are also prevalent when the number of pixels having a first pixel input value are much greater than the number of pixels having a second pixel input value.

The process 100 then displays the reference region 402 at the target visual output intensity with the selected pixel input values for the reference pixels (step 105). For example, to achieve a target visual output intensity of 50% red in an output display device 400 having RGB color space and a 24-bit data representation of a pixel, the process 100 first selects a pixel input value [FF 00 00] for each of a plurality of reference pixels such that the red sub-pixel for each pixel has a visual output intensity at 100% relative to the output display device 400, and the blue and green sub-pixels have a visual output intensity at 0% relative to the output display device 400. The process 100 then selects a second pixel input value [00 00 00] for each of the remaining reference pixels in the reference region 402 such that all the sub-pixels for each pixel have a visual output intensity at 0% relative to the output display device 400. The displayed reference region 402 has the target visual output intensity of 50% red.

Once the reference region 402 is displayed, the process 100 displays a control region 401 defined by a plurality of control pixels (step 106) on the output display device 400.

As shown in FIG. 4, the reference region 402 can enclose the control region 401, or can be displayed in close proximity to the control region, e.g., side by side. The reference region 402 should be sized large enough to insure the user's focus is able to be maintained on the reference region 402 while adjustments to the common pixel input value of the control pixels are made (described further below). The user must be able to view both the control region 401 and the reference region 402 at the same time without having to shift the eye's focus much, if at all.

The size of the control region 401, as viewed on the output device display 400, is determined by human interaction. The control region 401 should be large enough to be easily and comfortably viewed by the user, but not so large as to dominate the output device display 400. In one implementation, the ratio of the size of the control region 401 to the reference region 402 is 1:4. Other ratios can be used, however the size of the control region 401 should not exceed the size of the reference region 402 or less than ideal results may be achieved.

Each of the control pixels has a common pixel input value. The process 100 prompts the user to adjust the common pixel input value (step 107). In one implementation, the user can adjust the common pixel input value using a slider bar on the user interface to vary the common pixel input value over a specified range. In the example above, for the output display device 400 having RGB color space, the user can adjust the common pixel input value to vary between [00 00 00] and [FF 00 00] to achieve a visual output intensity for the control region 401 varying between 0% red and 100% red. Once the user indicates a match between the appearance of the reference region 402 and the appearance of the control region 401 (step 108), the process 100 associates the user-selected common pixel input value with the target visual output intensity (step 109) and the association is stored in the process's memory for use in future applications.

At this stage of processing, the process 100 determines if the set of pixel input values for which the corresponding visual output intensities are known is complete (step 110), as specified by the size of the set of pixel input values defined in step 101. If the set of pixel input values is complete, the process 100 is complete (step 111). If not, the process 100 undergoes an iterative process continuing at step 102 until the set of pixel input values is determined to be complete.

In one implementation, a curve may be fit to the pixel input values for which corresponding visual output intensities are known to produce a function that describes the relationship between the pixel input value and the corresponding visual output intensity over the entire range of visual output intensities, after which, the set of pixel input values can be discarded.

In another implementation, if the target visual output intensity of the reference region 402 cannot be obtained exactly from a combination of known pixel input values, the process 100 may undergo an iterative process to obtain target visual output intensities of the reference region 402 close to the target visual output intensity until either the target visual output intensity can be reproduced, or the user determines that the displayed visual output intensity is visually equivalent to the target visual output intensity.

In another implementation, the process 100 may establish a control region 401 and a reference region 402 for each color plane of the output display device 400, and prompt the user to adjust the common pixel input value to achieve a match between the appearance of the reference region 402 and the appearance of the control region 401 for each color plane.

Figure 2:
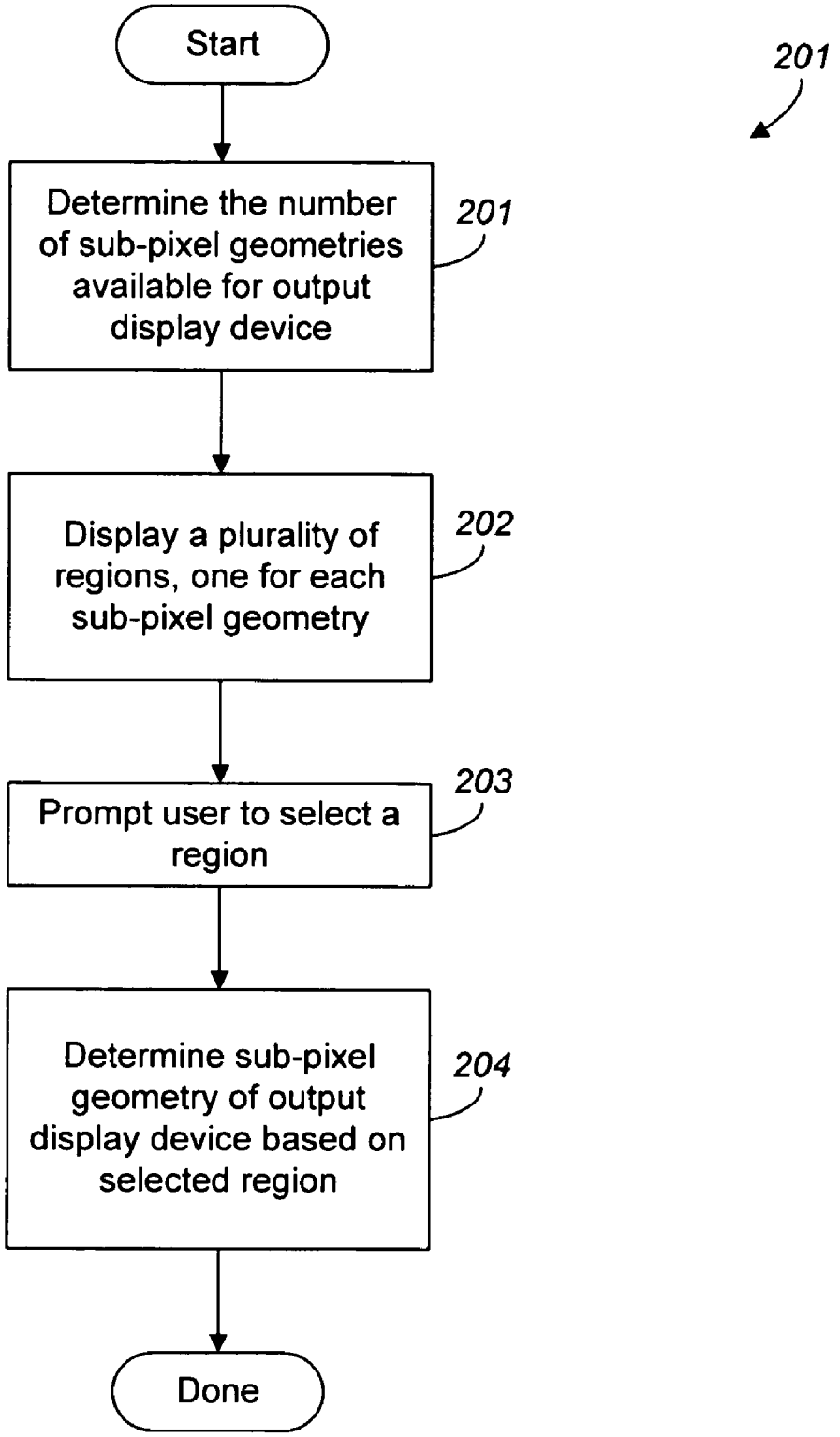
FIG. 2 is a flow diagram of a process for determining a device-specific sub-pixel geometry for all pixels of the output display device.
Figure 3:
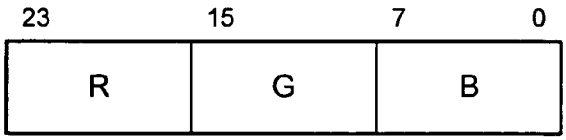
FIG. 3 shows a 24-bit data representation of a pixel in a RGB color space including 3 sub-pixels: red (R), green (G) and blue (B).

FIG. 2 is a flow diagram of a process 200 for determining a device-specific sub-pixel geometry for all pixels of the output display device 400. The sub-pixel geometry information is derived such that an optimal display of fine structure monochrome images is displayed on the output display device 400.

The process 200 first determines the number of sub-pixel geometries that are possible for a particular output display device 400 (step 201). The number of possible sub-pixel geometries depends on the number of sub-pixels per pixel in the output display device 400. For example, if the output display device 400 is constructed using the RGB color space, there are 6 (3 sub-pixels; 3!=6) possible sub-pixel geometries, as shown in FIG. 6. Whereas if the color space is CMYK, there are 24 (4 sub-pixels; 4!=24) possible sub-pixel geometries.

The process 200 then displays a plurality of regions, one for each possible sub-pixel geometry (step 202). Each region displayed by the process 200 includes a pattern that is susceptible to color fringing depending on the sub-pixel geometry of the output display device. In one implementation, used when evaluating an output display device 400 is constructed using the RGB color space, the pixels may comprise vertical rectangular color bars (sub-pixels) that form a square-shaped pixel. Each region displayed includes a pattern. In one implementation, the pattern comprises a series of single pixel-wide vertical lines separated from the next vertical line by a plurality of pixels. In one implementation, the vertical lines are white and displayed on a black background. A single pixel-wide vertical line is produced with no color fringing by setting adjacent sub-pixels distributed over 2 adjacent pixels to have visual output intensities of 100%. Illuminating a sub-pixel is defined by setting a sub-pixel to have a visual output intensity of 100%.

When evaluating an output display device 400 constructed using the RGB color space that has an unknown sub-pixel geometry, different test patterns are tested on different displayed regions. Implementing each test pattern available for an output display device 400 will result in the illumination of different color sub-pixels to form the single pixel-wide vertical lines. FIGS. 7*a* and 7*b* show a X-Y-Z test pattern implemented on an output display device having a X-Y-Z ordered sub-pixel geometry. The test pattern for an XYZ orientation region is produced as follows:

First sub-region>
pixel M: sub-pixel 3 (Z) is illuminated
pixel N: sub-pixels 4 (X) and 5 (Y) are illuminated
Second sub-region>
pixel M: sub-pixels 2 (Y) and 3 (Z) are illuminated
pixel N: sub-pixel 4 (X) is illuminated.

For example, a R-G-B test pattern is implemented in a region on an output display device having a R-G-B ordered sub-pixel geometry, by illuminating the sub-pixels as shown in FIG. 8*a*. The vertical lines displayed in both sub-regions of this region will appear without color fringing. Similarly, a B-G-R test pattern is implemented in a region on an output display device having a B-G-R ordered sub-pixel geometry, by illuminating the sub-pixels as shown in FIG. 8*b*. The vertical lines displayed in both sub-regions of this region will appear without color fringing. The test patterns for other output display devices having differently ordered sub-pixel geometries are produced in a similar fashion.

When the sub-pixel geometry of the output display device does not match the test pattern being implemented, color fringing is readily visible. For example, for an output display device having a R-G-B ordered sub-pixel geometry, implementing the R-G-B test would result in solid white vertical lines being formed (illuminating the B sub-pixel in pixel M, and the RG sub-pixels in pixel N for one sub-region, and illuminating the GB sub-pixels in pixel M and the R sub-pixel in pixel N for the other sub-region, both result in the 3 adjacent illuminated sub-pixels that form a white pixel). However, implementing the B-G-R test on the same output display device (illuminating the R sub-pixel in pixel M and illuminating the BG sub-pixels in pixel N in one sub-region, while illuminating the GR sub-pixels in pixel M and illuminating the B sub-pixel in pixel N in the other sub-region) would result in red, cyan, yellow and blue fringing effects at the edges of the white lines displayed therein.

FIG. 9 illustrates why the color fringing effects are visible when the B-G-R test is implemented on an output display device having a R-G-B ordered sub-pixel geometry. In one sub-region, the illuminated R sub-pixel in pixel M is separated from the illuminated GB sub-pixels in pixel N by 3 non-illuminated sub-pixels. Similarly in the other sub-region, the illuminated RG sub-pixels in pixel M are separated from the illuminated B sub-pixel in pixel N by 3 non-illuminated sub-pixels. When the R, G and B illuminated sub-pixels are not adjacent to each other, they form a white pixel with color fringing.

In one implementation, the different regions are displayed simultaneously. Alternatively, the different regions can be displayed individually, and the user can toggle between the regions prior to selecting a region. The process 200 prompts the user to select a displayed region by toggling a button on the user interface in step 203. In one implementation, the process 200 prompts the user to select the displayed region with the least color fringing. Once the user has selected a displayed region, the process 200 assigns the ordering of the sub-pixel geometry test implemented on the selected displayed region to be the device-specific sub-pixel geometry (step 204) and the process ends.

Alternatively, the process 200 prompts the user to select the displayed region with the most color fringing. Once the user has selected a displayed region, the process 200 assigns the complement ordering of the sub-pixel geometry test implemented on the selected displayed region to be the device-specific sub-pixel geometry (step 204) and the process ends. For example, if the R-G-B test is the test implemented on the displayed region selected to have the most color fringing, the process 200 assigns the B-G-R sub-pixel geometry to be the device-specific sub-pixel geometry.

In another implementation in RGB color space, the region displayed includes a pattern comprising single pixel-wide intersecting diagonal lines where the diagonal lines are formed by white pixels each distributed over 2 pixels. On some output devices and/or under particular lighting conditions, color fringing is more visible at diagonal intersections.

Other types of sub-pixel geometries are possible. For example, instead of sub-pixels arranged as a series of vertical color bars, an output device can include sub-pixels arranged in a different geometry, such as horizontal color bars. Other pixel geometries are also possible (non-square) as is shown in FIGS. 10*a* and 10*b*. For each type of sub-pixel geometry, the process 200 displays a series of test patterns to determine the ordering of the sub-pixels.

The invention can be implemented in digital electronic circuitry, or in computer hardware, firmware, software, or in combinations of them. Apparatus of the invention can be implemented in a computer program product tangibly embodied in a machine-readable storage device for execution by a programmable processor; and method steps of the invention can be performed by a programmable processor executing a program of instructions to perform functions of the invention by operating on input data and generating output. The invention can be implemented advantageously in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object-oriented programming language, or in assembly or machine language if desired; and in any case, the language can be a compiled or interpreted language. Suitable processors include, by way of example, both general and special purpose microprocessors. Generally, a processor will receive instructions and data from a read-only memory and/or a random access memory. Generally, a computer will include one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in, ASICs (application-specific integrated circuits).

To provide for interaction with a user, the invention can be implemented on a computer system having a display device such as a monitor or LCD screen for displaying information to the user and a keyboard and a pointing device such as a mouse or a trackball by which the user can provide input to the computer system. The computer system can be programmed to provide a graphical user interface through which computer programs interact with users.

The invention has been described in terms of particular embodiments. Other embodiments are within the scope of the following claims. For example, the steps of the invention can be performed in a different order and still achieve desirable results.

What is claimed is:

1. In a display system operable to display each of a plurality of pixels at a visual output intensity relative to an output display device according to a corresponding pixel input value, a method for determining device-specific information for pixels to obtain an optimal display of images on an output display device, the output display device having one or more color planes, the method comprising determining a set of device-specific pixel input values, based on user input, that will cause the display system to display a corresponding set of target visual output intensities relative to the output display device, the determining step including displaying a control region and a reference region on the output display device, the reference region being defined by a plurality of reference pixels, input values of the reference pixels being selected so that an average of visual output intensities of the reference pixels is a target visual output intensity, the control region being defined by a plurality of control pixels, each of the control pixels having a common pixel input value, evaluating the control region and reference region for each color plane of the display device, and adjusting the common pixel input value for the control pixels until a match is achieved between an appearance of the reference region and an appearance of the control region for each color plane, such that target visual output intensities are achieved, wherein the control region is in proximity to the reference region.

2. The method of claim 1, further comprising determining a device-specific sub-pixel geometry for all the pixels of the output display device where each pixel includes a plurality of sub-pixels each defining a color component and a sub-pixel position associated with a given pixel, such that displaying for each of the plurality of pixels a selected visual output intensity relative to the output display device at a sub-pixel position according to a corresponding pixel input value will cause the display system to display an optimal display of fine structure monochrome images on the output display device.

3. The method of claim 1, wherein the output display device is a color output display device.

4. The method of claim 1, wherein the determining step further includes displaying a reference region on the output display device, the reference region being defined by a plurality of reference pixels, the displaying step including selecting a pixel input value for each of the reference pixels to produce a target visual intensity.

5. The method of claim 4, wherein the pixel input value for each of the reference pixels are selected such that no perceived patterns are formed in the reference region.

6. The method of claim 5, wherein the perceived patterns are stripes.

7. The method of claim 5, wherein the perceived patterns are blocks.

8. The method of claim 4, further including locating the reference region and the control region in close proximity to each other.

9. The method of claim 4, wherein the number of pixels defining the control region is substantially smaller than the number of pixels defining the reference region.

10. The method of claim 4, wherein the reference region encloses the control region.

11. The method of claim 4, wherein the reference region and the control region are side-by-side.

12. The method of claim 1, further including a slider bar presented on a user interface so that based on user input, the common pixel input value may be adjusted between full on and full off, inclusive.

13. In a display system operable to display each of a plurality of pixels at a visual output intensity relative to an output device according to a corresponding pixel input value, a method for determining device-specific information for pixels, the method comprising:

obtaining a target visual output intensity;

establishing a reference region in a display device, the reference region being defined by a plurality of reference pixels;

selecting a pixel input value for each of the reference pixels from among a set of pixel input values for which the corresponding visual output intensities are known, the pixel input values being selected so that the average of the visual output intensities of the reference pixels is the target visual output intensity;

displaying the reference region with the selected pixel input values for the reference pixels;

displaying a control region on the display device, the control region being defined by a plurality of control pixels, each of the control pixels having a common pixel input value;

adjusting the common pixel input value in response to user input; and associating the common pixel input value with the target visual output intensity when a user input indicates a match between the appearance of the reference region and the appearance of the control region, wherein the control region is in proximity to the reference region.

14. The method of claim 13, wherein the target visual output intensity is obtained from user input.

15. The method of claim 13, wherein the numeric value defining the size of the set of pixel input values is obtained from user input.

16. The method of claim 13, wherein the numeric value defining the size of the set of pixel input values is a pre-programmed numeric value.

17. The method of claim 13, wherein the pixel input value for each of the reference pixels are selected such that no perceived patterns are formed in the reference region.

18. The method of claim 17, wherein the perceived patterns are stripes.

19. The method of claim 17, wherein the perceived patterns are blocks.

20. The method of claim 13, further including a slider bar presented on a user interface so that based on user input, the common pixel input value may be adjusted between full on and full off, inclusive.

21. The method of claim 13, further including locating the reference region and the control region in close proximity to each other.

22. The method of claim 13, wherein the number of pixels defining the control region is substantially smaller than the number of pixels defining the reference region.

23. The method of claim 13, wherein the reference region encloses the control region.

24. The method of claim 13, wherein the reference region and the control region are side-by-side.

25. The method of claim 13, further including evaluating a control region and reference region for each color plane of the display device and adjusting the common pixel input value to achieve a match between the appearance of the reference region and the appearance of the control region for each color plane.

26. In a display system operable to display a plurality of pixels, a method for determining device-specific information for pixels to obtain an optimal display of fine structure monochrome images on an output display device, the method comprising:

displaying a plurality of regions on the output display device, the displaying step including selecting a pattern for each region of the plurality of regions; and determining a device-specific sub-pixel geometry from a plurality of possible sub-pixel geometries for all pixels of the output display device, based on user input selecting a region of the plurality of regions, where each pixel includes a plurality of sub-pixels each defining a color component and a sub-pixel position associated with a given pixel.

27. The method of claim 26, further comprising determining a set of device-specific pixel input values that will cause the display system to display a corresponding set of target visual output intensities relative to the output display device, such that displaying for each of the plurality of pixels a selected visual output intensity relative to the output display device at a sub-pixel position according to a corresponding pixel input value will cause the display system to display an optimal display of fine structure monochrome images on the output display device.

28. The method of claim 26, wherein determining the device-specific sub-pixel geometry, comprises:

displaying a plurality of regions, one for each possible sub-pixel geometry, each region including a pattern that is susceptible to color fringing depending on the sub-pixel geometry for the output display device; and prompting a user to select a region.

29. The method of claim 28, wherein each region displayed includes two sub-regions comprising a first subregion including one or more colored lines on a colorless background and a second subregion including one or more colorless lines on a colored background.

30. The method of claim 29, wherein the first region includes one or more colored lines of a first color on a colored background of a second color and the second region includes one or more colored lines of the said second color on a colored background of said first color.

31. The method of claim 30, wherein the first region includes one or more black lines on a white background and the second region includes one or more white lines on a black background.

32. The method of claim 28, wherein each region displayed includes a pattern comprising vertical lines.

33. The method of claim 32, wherein the vertical lines are single pixel-wide vertical lines separated from the next vertical line by a plurality of pixels.

34. The method of claim 33, wherein the single pixel-wide vertical lines are composed of illuminated sub-pixels distributed over two adjacent pixels.

35. The method of claim 28, wherein each region displayed includes a pattern comprising intersecting diagonal lines.

36. The method of claim 35, wherein the intersecting diagonal lines are single pixel-wide diagonal lines.

37. The method of claim 36, wherein the single pixel-wide diagonal lines are composed of illuminated sub-pixels distributed over two adjacent pixels.

38. The method of claim 28, wherein the user is prompted to select the displayed region that evidences the least color fringing.

39. The method of claim 28, wherein the user is prompted to select the displayed region that evidences the most color fringing.

40. The method of claim 39, wherein the device-specific sub-pixel geometry is the complement of the sub-pixel geometry of the displayed region that evidences the most color fringing.

41. The method of claim 28, wherein only one of the displayed regions is free from color fringing.

42. The method of claim 41, wherein the user is prompted to select the displayed region that evidences the least color fringing.

43. The method of claim 41, wherein the user is prompted to select the displayed region that evidences the most color fringing.

44. The method of claim 43, wherein the device-specific sub-pixel geometry is the complement of the sub-pixel geometry of the displayed region that evidences the most color fringing.

45. The method of claim 28, wherein the number of sub-pixel geometries is dependent on the number of sub-pixels in a pixel.

46. The method of claim 45, wherein the number of sub-pixels is more than two and each sub-pixel defines a color component in a color space.

47. The method of claim 46, wherein the color space is the RGB color space.

48. The method of claim 46, wherein the color space is the CMYK color space.

49. The method of claim 28, wherein only one of the plurality of regions is displayed to the user at a time.

50. The method of claim 31, wherein a different region may be displayed to the user by toggling a button on a user interface.

51. The method of claim 26, wherein the sub-pixels are oriented for display on the output display device as a sequence of consecutive vertical color bars.

52. The method of claim 26, wherein the sub-pixels are rectangular-shaped.

53. The method of claim 26, wherein the sub-pixels are square-shaped.

54. The method of claim 26, wherein the sub-pixels are round-shaped.

55. In a display system operable to display each of a plurality of pixels at a visual output intensity relative to a liquid crystal display (LCD) device according to a corresponding pixel input value, a method for determining device-specific information for pixels to obtain an optimal display of images on a liquid crystal display (LCD) device, the LCD device having one or more color planes, the method comprising;

determining a set of device-specific pixel input values, based on user input, that will cause the display system to display a corresponding set of target visual output intensities relative to the liquid crystal display (LCD) device, the determining step including displaying a control region and a reference region on the liquid crystal display (LCD) device, the reference region being defined by a plurality of reference pixels, input values of the reference pixels being selected so that an average of visual output intensities of the reference pixels is a target visual output intensity, the control region being defined by a plurality of control pixels, each of the control pixels having a common pixel input value, evaluating the control region and the reference region for each color plane of the display device, and adjusting the common pixel input value for the control pixels until a match is achieved between an appearance of the reference region and an appearance of the control region for each color plane, such that target visual output intensities are achieved, wherein the control region is in proximity to the reference region.

56. The method of claim 55, further comprising determining a device-specific sub-pixel geometry for all the pixels of the liquid crystal display (LCD) device where each pixel includes a plurality of sub-pixels each defining a color component and a sub-pixel position associated with a given pixel, such that displaying for each of the plurality of pixels a selected visual output intensity relative to the liquid crystal display (LCD) device at a sub-pixel position according to a corresponding pixel input value will cause the display system to display an optimal display of fine structure monochrome images on the liquid crystal display (LCD) device.

57. The method of claim 55, wherein the liquid crystal display (LCD) device has a RGB color space.

58. In a display system operable to display a plurality of pixels, a method for determining device-specific information for pixels to obtain an optimal display of on a liquid crystal display (LCD) device, the method comprising:

displaying a plurality of regions on the liquid crystal display (LCD) device, the displaying step including selecting a pattern for each region of the plurality of regions; and determining a device-specific sub-pixel geometry from a plurality of possible sub-pixel geometries for all pixels of the liquid crystal display (LCD) device, based on user input selecting a region of the plurality of regions, where each pixel includes a plurality of sub-pixels each defining a color component and a sub-pixel position associated with a given pixel.

59. The method of claim 58, further comprising determining a set of device-specific pixel input values that will cause the display system to display a corresponding set of target visual output intensities relative to the liquid crystal display (LCD) device, such that displaying for each of the plurality of pixels a selected visual output intensity relative to the liquid crystal display (LCD) device at a sub-pixel position according to a corresponding pixel input value will cause the display system to display an optimal display of fine structure monochrome images on the liquid crystal display (LCD) device.

60. The method of claim 58, wherein the liquid crystal display (LCD) device has a RGB color space.

61. A computer-implemented method, comprising:

displaying a reference region in a display device, the reference region being defined by a plurality of reference pixels, the displaying step including selecting a pixel input value for each of the reference pixels to produce a target visual output intensity relative to the display device, the pixel input value for each of the reference pixels being selected so that an average of visual output intensities of the reference pixels is a target visual output intensity;

displaying a control region on the display device, the control region being defined by a plurality of control pixels, each of the control pixels having a common pixel input value;

adjusting the common pixel input value in response to user input until a visual match is achieved between the reference region and the control region, wherein the control region is in proximity to the reference region; and associating the common pixel input value with the target visual output intensity.

62. The method of claim 61, wherein adjusting the common pixel input value includes:

presenting a user interface operable to change the common pixel input value;

prompting the user to change the common pixel input value using the user interface; and prompting the user to indicate a visual match between the reference region and the control region.

63. A computer program product, tangibly stored on a computer-readable medium, for determining device-specific information for pixels to obtain an optimal display of images on an output display device, the output display device having one or more color planes, the computer program product comprising instructions operable to cause a programmable processor to:

determine a set of device-specific pixel input values, based on user input, that will cause the display system to display a corresponding set of target visual output intensities relative to the output display device, the instructions to determine including instructions to display a control region and a reference region on the output display device, the reference region being defined by a plurality of reference pixels, input values of the reference pixels being selected so that an average of visual output intensities of the reference pixels is a target visual output intensity, the control region being defined by a plurality of control pixels, each of the control pixels having a common pixel input value, evaluate the control region and reference region for each color plane of the display device, and adjust the common pixel input value for the control pixels until a match is achieved between an appearance of the reference region and an appearance of the control region for each color plane, such that target visual output intensities are achieved, wherein the control region is in proximity to the reference region.

64. The computer program product of claim 63, further comprising instructions operable to cause the programmable processor to determine a device-specific sub-pixel geometry for all the pixels of the output display device where each pixel includes a plurality of sub-pixels each defining a color component and a sub-pixel position associated with a given pixel, such that the instructions to display for each of the plurality of pixels a selected visual output intensity relative to the output display device at a sub-pixel position according to a corresponding pixel input value will cause the display system to display an optimal display of fine structure monochrome images on the output display device.

65. A computer program product, tangibly stored on a computer-readable medium, for determining device-specific information for pixels, the computer program product comprising instructions operable to cause a programmable processor to:

obtain a target visual output intensity;

establish a reference region in a display device, the reference region being defined by a plurality of reference pixels;

select a pixel input value for each of the reference pixels from among a set of pixel input values for which corresponding visual output intensities are known, the pixel input values being selected so that an average of the visual output intensities of the reference pixels is a target visual output intensity;

display the reference region with the selected pixel input values for the reference pixels;

display a control region on the display device, the control region being defined by a plurality of control pixels, each of the control pixels having a common pixel input value;

adjust the common pixel input value in response to user input; and associate the common pixel input value with the target visual output intensity when a user input indicates a match between an appearance of the reference region and an appearance of the control region, wherein the control region is in proximity to the reference region.

66. A computer program product, tangibly stored on a computer-readable medium, for determining device-specific information for pixels to obtain an optimal display of images on an output display device, the computer program product comprising instructions operable to cause a programmable processor to:

display a plurality of regions on the output display device, the displaying step including selecting a pattern for each region of the plurality of regions; and determine a device-specific sub-pixel geometry from a plurality of possible sub-pixel geometries for all pixels of the output display device, and based on user input select a region of the plurality of regions, where each pixel includes a plurality of sub-pixels each defining a color component and a sub-pixel position associated with a given pixel.

67. The computer program product of claim 66, wherein the instructions for determining the device-specific sub-pixel geometry, comprise instructions operable to cause the programmable processor to:

display a plurality of regions, one for each possible sub-pixel geometry, each region including a pattern that is susceptible to color fringing depending on the sub-pixel geometry for the output display device; and prompt a user to select a region.

68. A computer program product, tangibly stored on a computer-readable medium, for determining device-specific information for pixels to obtain an optimal display of images on a liquid crystal display (LCD) device, the LCD device having one or more color planes, the computer program product comprising instructions operable to cause a programmable processor to:

determine a set of device-specific pixel input values, based on user input, that will cause a display system to display a corresponding set of target visual output intensities relative to the liquid crystal display (LCD) device, the instruction to determine including instructions to display a control region and a reference region on the liquid crystal display (LCD) device, the reference region being defined by a plurality of reference pixels, input values of the reference pixels being selected so that an average of visual output intensities of the reference pixels is a target visual output intensity the control region being defined by a plurality of control pixels, each of the control pixels having a common pixel input value, evaluate the control region and the reference region for each color plane of the display device, and adjust the common pixel input value for the control pixels until a match is achieved between an appearance of the reference region and an appearance of the control region for each color plane, such that target visual output intensities are achieved, wherein the control region is in proximity to the reference region.

69. The computer program product of claim 68, further comprising instructions operable to cause the program able processor to determine a device specific sub-pixel geometry for all the pixels of the liquid crystal display (LCD) device where each pixel includes a plurality of sub-pixels each defining a color component and a sub-pixel position associated with a given pixel, such that the instructions to display for each of the plurality of pixels a selected visual output intensity relative to the liquid crystal display (LCD) device at a sub-pixel position according to a corresponding pixel input value will cause the display system to display an optimal display of images on the liquid crystal display (LCD) device.

70. A computer program product, tangibly stored on a computer-readable medium, for determining device-specific information for pixels to obtain an optimal display of images on a liquid crystal display (LCD) device, the computer program product comprising instructions operable to cause a programmable processor to:

display a plurality of regions on the liquid crystal display (LCD) device, the instructions to display including instructions to select a pattern for each region of the plurality of regions; and determine a device-specific sub-pixel geometry from a plurality of possible sub-pixel geometries for all pixels of the liquid crystal display (LCD) device, and based on user input select a region of the plurality of regions, where each pixel includes a plurality of sub-pixels each defining a color component and a sub-pixel position associated with a given pixel.

71. A computer program product, tangibly stored on a computer-readable medium, comprising instructions operable to cause a programmable processor to:

display a reference region in a display device, the reference region being defined by a plurality of reference pixels, the instructions to display including instructions to select a pixel input value for each of the reference pixels to produce a target visual output intensity relative to the display device, the pixel input value for each of the reference pixels being selected so that an average of visual output intensities of the reference pixels is a target visual output intensity;

display a control region on the display device, the control region being defined by a plurality of control pixels, each of the control pixels having a common pixel input value;

adjust the common pixel input value in response to user input until a visual match is achieved between the reference region and the control region, wherein the control region is in proximity to the reference region; and associate the common pixel input value with the target visual output intensity.

* * * * *

UNITED STATES PATENT AND TRADEMARK OFFICE

CERTIFICATE OF CORRECTION

PATENT NO. : 6,954,216 B1 
DATED : October 11, 2005
INVENTOR(S) : Terence S. Dowling and Jeremy A. Hall It is certified that error appears in the above-identified patent and that said Letters Patent is hereby corrected as shown below:

Column 12,
Line 5, delete “31” and replace with -- 49 --;
Line 24, delete “;” and replace with -- : --;
Line 61, delete “of”;

Column 15,
Line 27, delete “intensity” and replace with -- intensity, --;
Line 40, delete “program able” and replace with -- programmable --;
Line 41, delete “device specific” and replace with -- device-specific --.

Signed and Sealed this

Third Day of January, 2006

JON W. DUDAS
*Director of the United States Patent and Trademark Office*